United States Patent [19]

Pushee

[11] Patent Number: 4,911,146

[45] Date of Patent: Mar. 27, 1990

[54] DEVICE FOR FIREPLACE COOKING

[75] Inventor: Peter R. Pushee, Randolph, Vt.

[73] Assignee: Ironsmith, Inc., Randolph, Vt.

[21] Appl. No.: 404,662

[22] Filed: Sep. 7, 1989

[51] Int. Cl.[4] ..... F24B 1/26

[52] U.S. Cl. ..... 126/506; 126/30; 126/25 A; 248/283

[58] Field of Search ..... 126/506, 29, 30, 25 R, 126/25 A, 25 AA, 9 R, 9 B; 99/450, 339; 248/282, 283, 295.1, 297.3

[56] References Cited

U.S. PATENT DOCUMENTS

| | | | |
|---|---|---|---|
| D. 288,165 | 2/1987 | Thomas | D7/408 |
| 307,963 | 11/1884 | Kotzum | 248/282 |
| 2,998,001 | 8/1961 | Lofgran et al. | 126/30 |
| 3,111,123 | 11/1963 | Le Fort | 126/506 |
| 3,391,685 | 7/1968 | Lemmons et al. | 126/25 A |
| 3,834,370 | 9/1974 | Nelson | 126/30 |
| 4,086,905 | 5/1978 | Dawson | 126/25 A |
| 4,437,450 | 3/1984 | Connelly | 126/30 |
| 4,627,413 | 12/1986 | Watson | 126/506 |
| 4,766,879 | 8/1988 | Freese | 126/30 |

*Primary Examiner*—James C. Yeung
*Attorney, Agent, or Firm*—Michael J. Weins

[57] ABSTRACT

The present invention is for a fireplace cooking device which provides for translation a grill or other cooking device in three orthogonal directions. The device has a wall assembly which attaches to the sidewall of the fireplace and maintains a mechanism to raise or lower a grill or other cooking device. Attached to the wall assembly are a series of elements which are pivotably mounted to provide planar translation of a grill or other cooking device.

7 Claims, 4 Drawing Sheets

DEVICE FOR FIREPLACE COOKING

FIELD OF THE INVENTION

The present invention relates to a device for cooking over an open fire in an enclosed volume such as a fireplace, and more particularly to a device that will support a grill or other cooking element and allow for its translation in three orthogonal directions.

BACKGROUND OF THE INVENTION

A variety of cooking grills have been developed for use in fireplaces. Classically these grills have been supported by a stand resting on the floor of the fireplace as is illustrated in Des. 288,165 patent, attached to a fuel grate or basket as in 4,086,905, or affixed to a pole as is taught in 4,766,879 patent. All of the above geometric configurations allow limited movement and thus do not permit a general X-Y-Z translation and do not provide for simple adjustment in three orthogonal directions. Furthermore, these devices are not designed to provide for a grill that can be swung into and out of the fireplace during use for monitoring the cooking. Thus there is a need for a fireplace cooking device which will readily provide an X-Y-Z translation of a grill for placing the food at an appropriate distance from the fire during cooking and which can be readily swung into and out of the fire to monitor the cooking.

SUMMARY OF THE INVENTION

It is an object of the invention to provide a cooking device which attaches to a side wall of a fireplace and can be stored against the wall of the fireplace when not in use.

It is another object of the invention to provide a cooking device which will allow a kettle to be suspended therefrom.

It is another object of the invention to provide a device that will provide general X-Y-Z translation of a grill.

It is still a further object of the invention to provide a device that can readily insert and remove the grill from the fireplace and allow monitoring of the food during cooking.

Still a further object of the invention is to provide a device where the food can be readily moved away from the fire and held in the fireplace for warming.

These and other objects of the invention will become apparent to one skilled in the art from the following figures, description, and claims.

The device of present invention in its simplest form attaches to the sidewall of a fireplace and provides a movable support for cooking elements attached thereto. The device has a frame which attaches to the sidewall of the fireplace. The frame supports a track having a top end and a bottom end. The track is attached to the frame in a spaced apart relationship.

A corrugated surface substantially parallel to the track is attached to the frame. The corrugated surface has ridges positioned substantially normal to the track.

A knuckle slidably engages the track. The knuckle has an extension attached thereto. Means are provided to assure that the extension moves substantially parallel to the ridges of the corrugated surface.

A lever is pivotably mounted on the extension. The lever has a first lever arm which joins a second lever arm. The junction of the first lever arm and second lever arm is the pivot point of the lever. The first lever arm extends away from the corrugated surface while the second lever arm extends toward the corrugated surface and has a length greater than the separation between the junction and the corrugated surface.

Means are provided for maintaining the second lever arm in contact with the corrugated surface when the device is installed in the fireplace. The preferred means is by distributing the weight between the two lever arms such that when the frame is attached to the sidewall of the fireplace the center of gravity of the lever arms will generate a moment maintaining the second lever arm in contact with the corrugated surface. When the frame is attached to the sidewall of the fireplace, the knuckle will be directed toward the bottom end of the track and wedgably engaging in the second level arm in the corrugated surface, locking the knuckle in position.

A radius arm has a first arm segment and a second arm segment with the first arm segment and the second arm segment lying in planes which are substantially normal to each other. The first segment of the radius arm rotatably attaches to the knuckle extension.

A lateral bar is provided which has a first bar end and a second bar end. The first bar end rotatably attaches to the second radius arm segment of the radius arm.

A boom is provided which has a first boom end and a second boom end. The first boom end is rotatably attached to the second end of the lateral bar. Means are provided to the second boom end for attachment of cooking utensils.

General three dimensional motion is obtained by the sliding movement of the knuckle in combination with the rotation of the radius arm, the lateral bar, and the boom.

BRIEF DESCRIPTION OF THE FIGURES

FIG. 3 shows the second lever arm wedged against the corrugated surface.

BEST MODE FOR PRACTISING THE INVENTION

Figure 1:
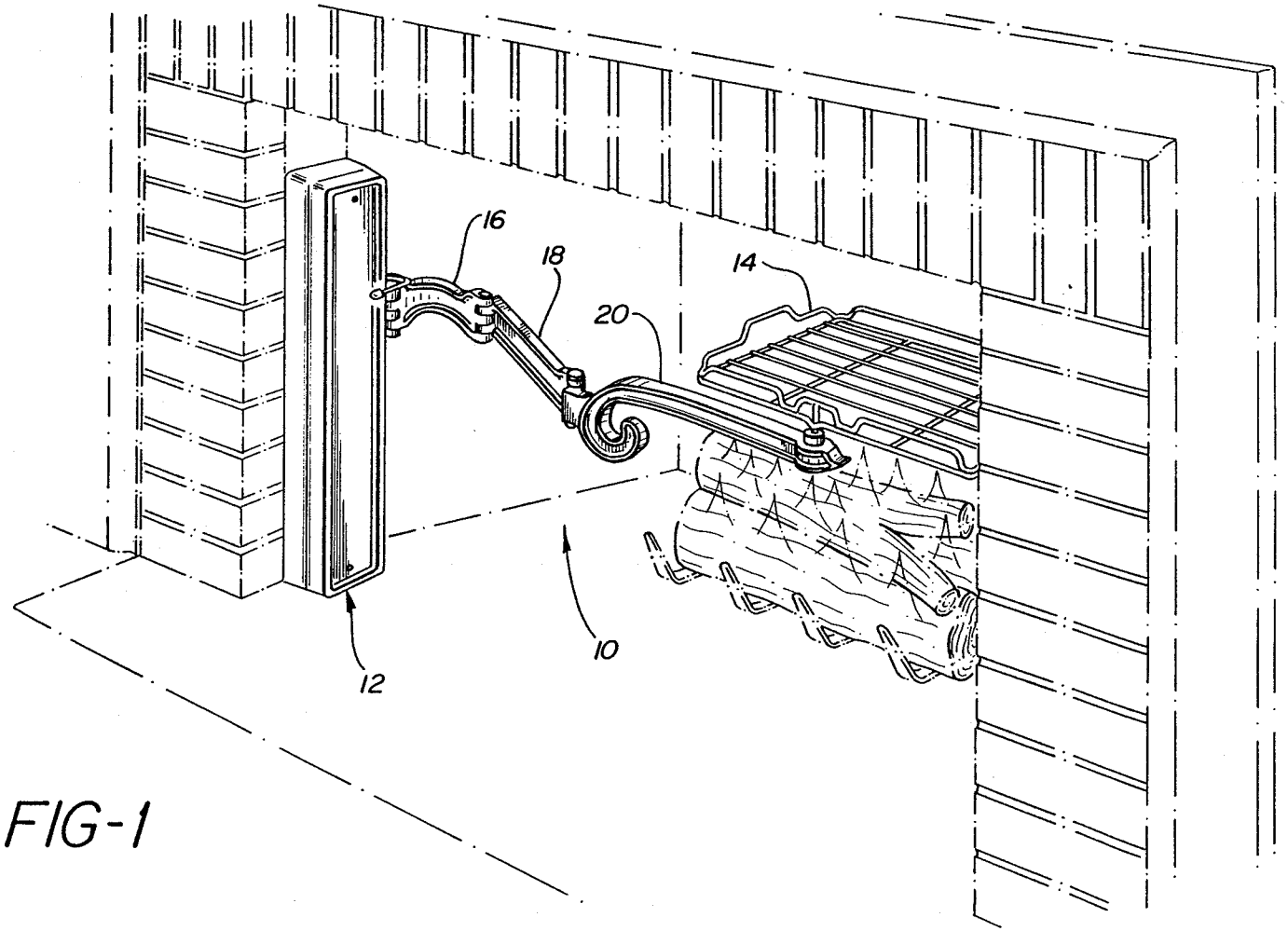
FIG. 1 illustrates one embodiment of the cooking device of the present invention positioned in a fireplace.

FIG. 1 illustrates one embodiment of the present invention for a fireplace cooking device 10 of the present invention. A wall assembly 12 mounts on the fireplace wall shown in phantom lines. The wall assembly 12 houses a mechanism for raising and lowering a grill 14 which attaches to the device 10. General three dimensional translation is effected by the raising and lowering of a radius arm 16; in combination with the rotation of the radius arm 16, a lateral bar 18, a boom 20, and the grill 14.

Figure 2:
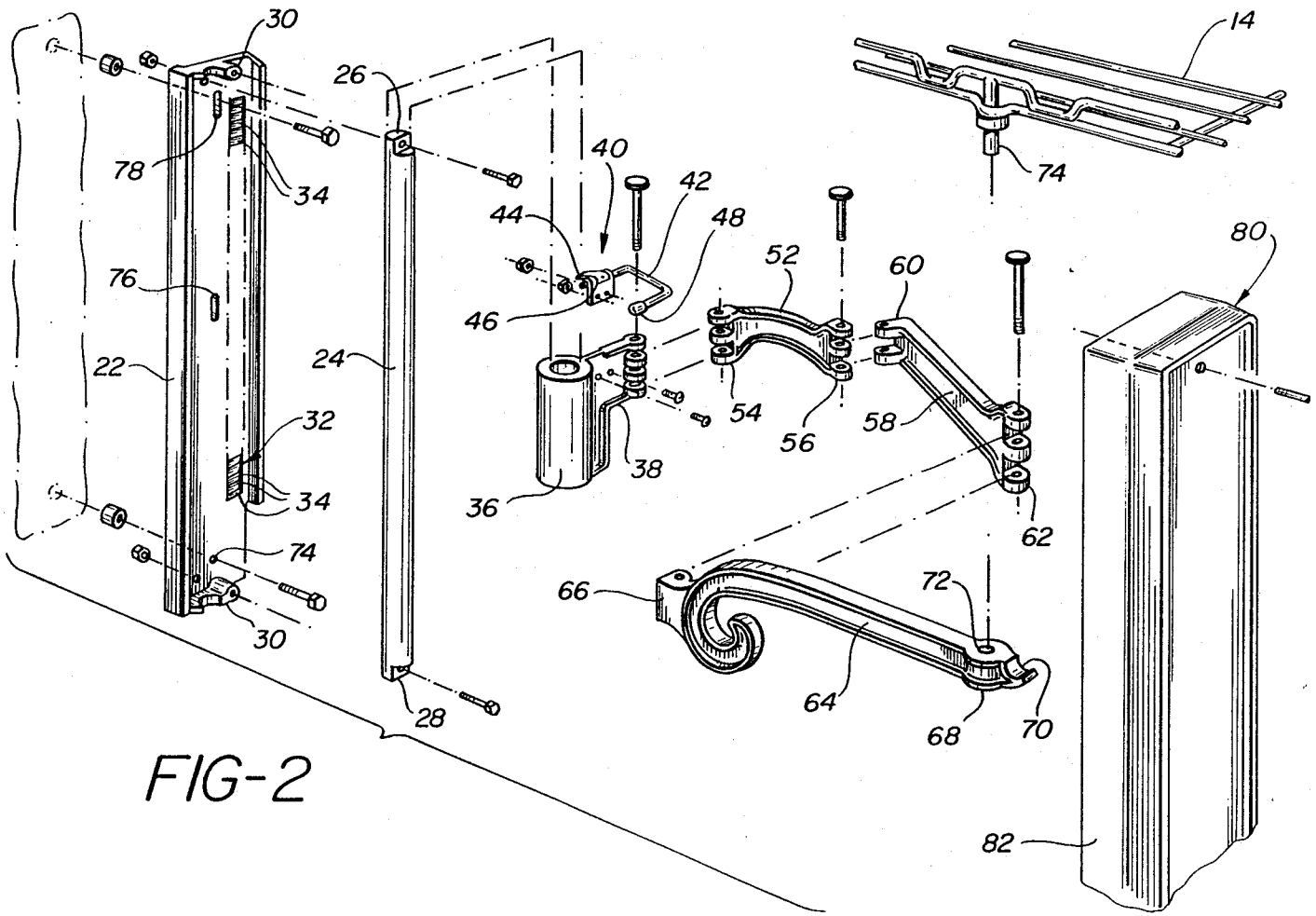
FIG. 2 is an exploded view of the embodiment of FIG. 1 showing how the components connect.

FIG. 2 shows an exploded view of the cooking device of FIG. 1. The device 10 has a frame 22 which is part of the wall assembly 12 of FIG. 1. The frame 22 attaches to the wall of the fireplace. A track 24 having a top end 26 and a bottom end 28 is connected in a spaced apart relationship with respect to the frame 22 by spacers 30. A corrugated surface 32 is positioned such that its ridges 34 are substantially normal to the track 24. The corrugated surface is attached to the frame 22 or can be made an integral part of the frame 22.

A knuckle 36 slidably engages the shaft 24. The knuckle 36 has an extension 38 attach thereto. A lever 40 having a first lever arm 42 and a second lever arm 44 is pivotably mounted on the extension 38 and pivots at the junction 46 of the first lever arm 42 and the second lever arm 44. The second lever arm 44 which extends from junction 46 toward the corrugated surface wedgably engages the corrugated surface 32 when the knuckle 36 moves toward the bottom end 28 of the shaft 24. The wedging results from the configuration of the lever arms (42 and 44), their position with respect to the the corrugated surface 32, and the force applied to the second lever arm by the weight of the knuckle 36.

Figure 3:
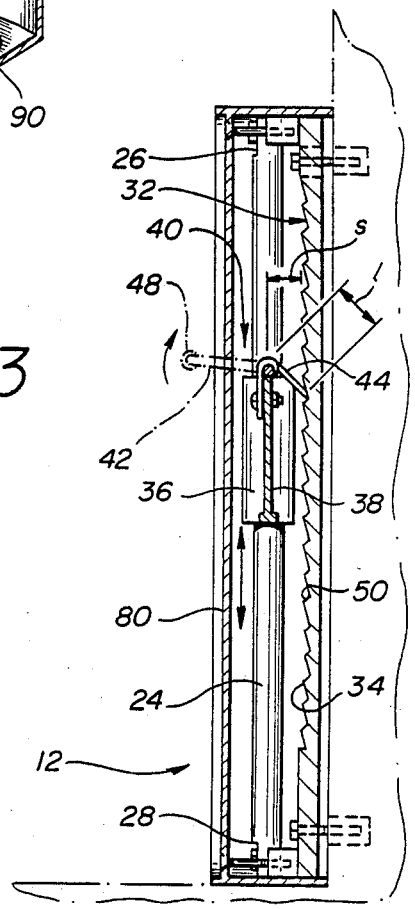
FIG. 3 illustrates details of the knuckle, lever, and corrugated surface.

FIG. 3 illustrates the configuration of the lever 40 within the second lever arm 44 wedged in the corrugated surface 32. The first lever arm 42 extends away from the corrugated surface 32. The second lever arm 44 extends from the pivot point 46 toward the corrugated surface 32. The second arm 44 has a length (1) which is greater than the separation s between the pivot point 46 and the corrugated surface 32. The first lever arm 42 has its center of gravity so located with respect to the pivot point 46 that the moment it generates is greater than the moment generated by the center of gravity for the second lever arm 44. Having the center of gravity of the first lever arm 42 so positioned assures that gravity will keep the second arm 44 in contact with the corrugated surface 32. It is preferred that a counterweight 48 be attached to the extremity of the first lever arm 42 to assure sufficient displacement of the center of gravity of the first lever arm 42 to assure contact between the second lever and the corrugated surface 32. It should also be appreciated that other means such as springs could be employed to maintain the second arm 44 in contact with the corrugated surface 32.

When the first lever arm 42 is raised, as is indicated by the arrow, the second lever arm 44 will clear the corrugated surface 32 and the knuckle 36 can freely move down. In order to facilitate the disengagement of the second lever arm 44 from the corrugated surface 32 it is preferred that the lower facets 50 of the corrugated surface 32 be sloped downward.

Referring again to FIG. 2 a radius arm 52 has a first arm segment 54 and a second arm segment 56. The first arm segment 54 lies in a plane that is substantially normal to the plane in which the second arm segment 56 lies. The first arm segment 54 of the radius arm 52 is rotatably connected to the extension 38 of the knuckle 36.

A lateral bar 58 has a first bar end 60 and a second bar end 62. The first bar end 60 is rotatably attached to the second arm segment 56 of the radius arm 52.

A boom 64 has a first boom end 66 and a second boom end 68 with the first boom end 68 being rotatably attached to the second bar end 62 of the lateral bar 58. A hook 70 is formed on the second boom end 68 which can serve as means for attaching a cooking element such as a kettle shown in FIG. 5. An alternative means for supporting other cooking devices such as the grill 14 shown in FIG. 1 is provided by a passage 72 in the second end 68 of the boom 64. The passage 72 engages a post 74 which supports the grill 14.

It is preferred that the lateral bar 58 and the boom 64 be so connected that they can be positioned in an over and under relationship that will provide for storage of the lateral arm and the boom in close proximity to the wall of the fireplace. It is further preferred that the cross sections of the radius arm 52, the lateral bar 58 and the boom 64 have an "I" cross section.

Mounting holes 74, 76, and 78 are provided for attaching the base 22 to the fireplace wall. The lower mounting hole 74 is circular, while the middle hole 76 and the upper hole 78 are elongated. Preferably, the length of elongated holes (76 and 78) is about 1 inch to allow the positioning of the mounting bolts such that they will be embedded in the blocks of the wall and secure the frame 22 to the fireplace wall.

Figure 4:
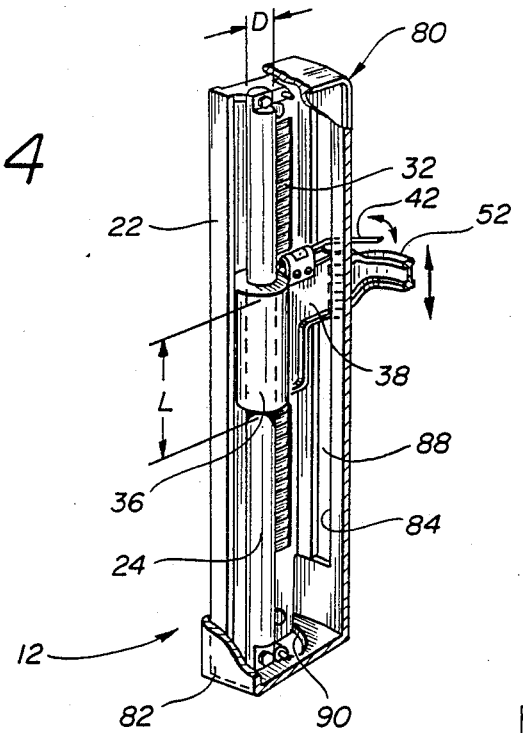
FIG. 4 is a partial section of the cover and mounting frame showing a slot formed between the cover and the frame in which a knuckle extension travels.

A cover 80 is provided that attaches to the frame 22, a partial section of the cover 80 which is shown attached to the frame 22 in FIG. 4. The cover 80 has a rim 82 which engages the frame 22. The cover 80 has a recess 84 in the rim 82. When the cover 80 is placed on the frame 22 the recess 84 in the rim 82 provides a slot 88 in which the extension 38 of the knuckle 36 travels. The slot 84 provides means for maintaining the extension 38 in parallel relation to the corrugated surface 32 and limits the movement of the knuckle 36. The cover 80 is provided with openings 90 in the bottom of the cover 80. The openings 90 allow for elimination of foreign matter which may become entrapped in the casing 80 during service.

It is preferred that the track 24 is cylindrical as illustrated in FIGS. 2, 3, and 4. This configuration will allow for the knuckle 36 to rotate when the cover 80 is removed by providing better access to the radius arm 52, the horizontal bar 58, and the boom 64 for service.

It is further preferred that the length L of the knuckle 34 be at least about two and one half times the diameter D of the track 24 to assure smooth movement of the knuckle 34 on the track 24.

Figure 5:
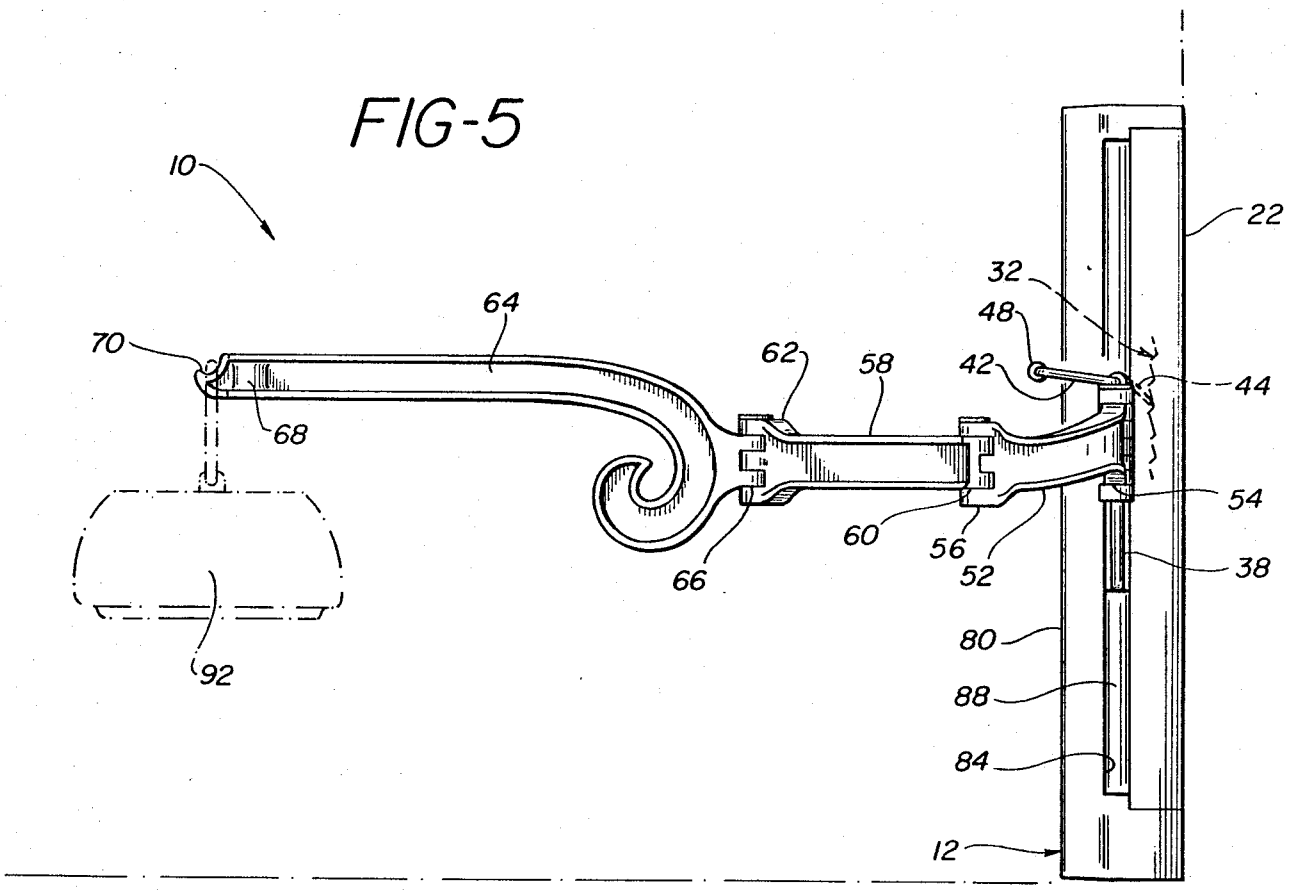
FIG. 5 illustrates the device of present invention supporting a kettle.

FIG. 5 is a view of the present invention illustrating the slot in the sidewall assembly 12 and the relative elevation of the radius arm 52, the lateral bar 58, and the boom 64. The device 10 is illustrated with kettle 92 which attaches by hook 70 of the boom 64.

While the novel features of the present apparatus have been described in terms of particular embodiments and preferred applications, it should be appreciated by one skilled in the art that substitution of materials and details obviously can be made without departing from the spirit of the invention.

What I claim is:

1. A cooking device for use in a fireplace comprising:

a frame;

a track having a top end and a bottom end, said track being attached to said frame in a spaced apart relationship;

a knuckle slidably engaging said track having an extension thereon;

a lever having a first lever arm joined to a second lever arm meeting in a junction there between, said junction being pivotably mounted on said extension of said knuckle;

a corrugated surface substantially parallel to said track attached to said frame, said corrugated surface having ridges positioned substantially normal to said track and having lower facets which wedgably engage said second lever arms;

means for maintaining said second lever arm in contact with said corrugated surface thereby causing said second lever arm to wedgably engage said corrugated surface when said knuckle is moved toward said bottom end;

a radius arm having a first arm segment and a second arm segment, said first and said second arm segment lying in planes substantially normal with respect to each other, and said first arm segment being rotatably attached to said extension;

a lateral bar having a first bar end and a second bar end, said first bar end being rotatably connected to said second arm segment;

a boom having a first boom end and a second boom end, said first boom end rotatably mounted to said second lateral bar end; and means for attaching a cooking utensil to said boom.

2. The cooking device of claim 1 wherein said lower facets slope downward toward said bottom end of said track.

3. The cooking device of claim 2 wherein said means for maintaining said second arm in contact with said corrugated surface results from maintaining the center of gravity of said first lever arm and said second lever arm such that a resulting torque maintains said second arm segment in contact with said corrugated surface.

4. The cooking device of claim 4 wherein said shaft is cylindrical and further comprising a frame cover having a rim with a recess therein which is positioned such that when the rim engages said frame a slot is provided in which said extension of said knuckle travels.

5. The cooking device of claim 4 wherein said knuckle engages said track over a length greater than about two and one half times the diameter of the bar.

6. The cooking device of claim 5 wherein said means for attaching said cooking utensil further comprising a hook being an integral part of the said second boom end.

7. The cooking device of claim 6 further comprising passage for engaging a post of a grill providing a rotatably mounted grill.

* * * * *